US008011764B2

(12) United States Patent
Hawkins et al.

(10) Patent No.: US 8,011,764 B2
(45) Date of Patent: Sep. 6, 2011

(54) DEVICE INCLUDING MOVEABLE PORTION FOR CONTROLLING FLUID

(75) Inventors: Gilbert A. Hawkins, Mendon, NY (US); Zhanjun Gao, Rochester, NY (US); Yonglin Xie, Pittsford, NY (US); Edward P. Furlani, Lancaster, NY (US); Kam C. Ng, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 321 days.

(21) Appl. No.: 12/420,837

(22) Filed: Apr. 9, 2009

(65) Prior Publication Data

US 2010/0258195 A1 Oct. 14, 2010

(51) Int. Cl.
*B41J 2/02* (2006.01)

(52) U.S. Cl. ..... 347/73

(58) Field of Classification Search ..... 347/14, 347/73–77

See application file for complete search history.

(56) References Cited

U.S. PATENT DOCUMENTS

| | | | | |
|---|---|---|---|---|
| 4,138,686 | A | 2/1979 | Graf | |
| 4,249,188 | A | 2/1981 | Graf | |
| 4,264,910 | A | 4/1981 | Graf | |
| 7,249,828 | B2 * | 7/2007 | Gelbart et al. | 347/74 |
| 2005/0185031 | A1 * | 8/2005 | Steiner et al. | 347/74 |

* cited by examiner

*Primary Examiner* — Lamson D Nguyen
(74) *Attorney, Agent, or Firm* — William R. Zimmerli

(57) ABSTRACT

A device and a method of controlling fluid flow are provided. The method includes providing a moving fluid including a fluid flow characteristic; providing a fluid control device including a fluid control surface, a portion of the fluid control surface being moveable; causing the fluid to contact the fluid control surface of the fluid control device; and causing the fluid to interact with the fluid control surface of the fluid control device by moving the moveable portion of the fluid control surface while the fluid is in contact with the fluid control surface such that the fluid flow characteristic of the fluid after interacting with the fluid control surface of the fluid control device is different from the fluid flow characteristic of the fluid before interaction with the fluid control surface of the fluid control device depending on the position of the moveable portion of the fluid control surface.

13 Claims, 13 Drawing Sheets

DEVICE INCLUDING MOVEABLE PORTION FOR CONTROLLING FLUID

CROSS REFERENCE TO RELATED APPLICATIONS

Reference is made to commonly-assigned, U.S. patent application Ser. No. 12/420,842, entitled "DEVICE FOR CONTROLLING FLUID VELOCITY", Ser. No. 12/420,838, entitled "DEVICE FOR CONTROLLING DIRECTION OF FLUID", Ser. No. 12/420,839, entitled "INTERACTION OF DEVICE AND FLUID USING FORCE", and Ser. No. 12/420,846, entitled "DEVICE FOR MERGING FLUID DROPS OR JETS", all filed concurrently herewith.

FIELD OF THE INVENTION

This invention relates generally to formation and control of fluid drops, and in particular to control devices that either actively or passively control fluid drops via interaction of a fluid jet and a control device surface at or near the region of fluid jet breakoff.

BACKGROUND OF THE INVENTION

The ability to reliably and accurately position drops ejected from fluid ejectors, for example, inkjet printheads, at predetermined locations is a critical systems requirement for the printing of high-quality pictorial images and text. Accurate positioning of drops on the receiver is difficult because ejected drops suffer from both stochastic (random) placement inaccuracies and repeating (semi-permanent) placement inaccuracies. Examples of a stochastic (random) placement inaccuracy includes drop-to-drop variations in the contact point of the drop tail as is leaves the ejector surface and fluctuations in the airflow around the printhead. Examples of repeating (semi-permanent) placement inaccuracies include permanently malformed ejectors and particulate debris contacting the ejector nozzle plate.

In some situations, accurate positioning of drops may be achieved by locating the receiver in close proximity to the printhead, so that drops which are angularly misdirected do not have time to travel too far from their desired location on the receiver in the plane of the receiver. However, overly close spacing may cause mechanical contact between the printhead and the receiver possibly resulting in printhead damage.

Other strategies to control drop locations include the use of airflow or electric fields oriented in the direction of the drop trajectories to guide drops to desired locations as well as the application of electric fields perpendicular to the direction of the drop trajectories to guide drops to desired locations. However, these strategies need to use very large airflows or very high electric fields to influence drop trajectories which possibly resulting in image artifacts and reduced system reliability.

Accurate positioning of drops on the receiver is also limited by the formation of satellite drops during drop breakup or by drop recombination as drops travel along their trajectories. Drops of unusually small or large sizes are produced which reduce image quality or cause reliability problems due to fluid accumulation at unwanted regions. Although satellite formation can be controlled to some extent by ink formulation or printhead operation parameters, these solutions typically reduce image quality or printer performance, for example by requiring special ink formulations not optimized for image quality or by necessitation reduced printing speeds.

The inverse relationship between frequency of operation and drop control also contributes to accurately positioning drops. In general, it is desirable to operate inkjet printers at the highest possible frequencies for reasons of productivity. However, drop placement typically suffers at high frequency operation while the propensity of satellite formation or drop recombination typically increases.

SUMMARY OF THE INVENTION

According to one aspect of the present invention, the formation and control of a fluid drop(s) produced by fluid drop ejectors, for example, drop ejectors of the drop-on-demand type or continuous type, are managed either passively or actively.

The control device of the present invention can be positioned remotely from the surface of the drop ejectors. For example, when the drop ejector is a continuous type ejector, the control device can be positioned at or near the location of drop break-off from the jetting fluid column so that the fluid leaving the control surface of the control device after interacting with the control surface of the control device can be in the form of a fluid jet or a fluid drop(s). Additionally, an array of control devices can be remotely positioned from the surface of a corresponding array of drop ejectors.

The control device of the present invention either passively or actively modifies drop velocity, trajectory, or combinations thereof through interaction of a surface of a control device and the fluid jet or the fluid drop(s). For example, the control devices of the present invention can modify drop trajectories through contact of the surface of a control device and the drop(s) as the drop(s) travels across the surface of the control device or exits the surface of the control device. This can occur on a drop by drop basis. Additionally, when incoming fluid jets suffering from variations in directionality interact with the control surface of the control device of the present invention, the trajectory of the corresponding exiting drops can be at least partially corrected.

The control device of the present invention also has the ability to selectively suppress satellite drops and to reduce inadvertent drop merger. For example, the control surface of the control device can be designed to passively or actively control (modulate) the trajectory and velocity of the exiting drops relative to the that of the incoming drops on a drop by drop basis so as to cause satellite drops to merge with other drops or prevent drops from inadvertently merging with each other.

According to another aspect of the present invention, a method of controlling fluid flow includes providing a moving fluid including a fluid flow characteristic; providing a fluid control device including a fluid control surface, a portion of the fluid control surface being moveable; causing the fluid to contact the fluid control surface of the fluid control device; and causing the fluid to interact with the fluid control surface of the fluid control device by moving the moveable portion of the fluid control surface while the fluid is in contact with the fluid control surface such that the fluid flow characteristic of the fluid after interacting with the fluid control surface of the fluid control device is different from the fluid flow characteristic of the fluid before interaction with the fluid control surface of the fluid control device depending on the position of the moveable portion of the fluid control surface.

According to another aspect of the present invention, a microfluidic device includes a fluid source and a fluid control device. The fluid source provides a moving fluid with the moving fluid including a fluid flow characteristic. The fluid control device includes a fluid control surface. A portion of the fluid control surface is moveable. The fluid control surface is positioned relative to the moving fluid such that the moving fluid contacts the fluid control surface of the fluid control device. The moveable portion of the fluid control surface is moveable while the fluid is in contact with the fluid control surface such that the fluid flow characteristic of the moving fluid after interaction with the fluid control surface of the fluid control device is different from the fluid flow characteristic of the moving fluid before interaction with the fluid control surface of the fluid control device.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 2:
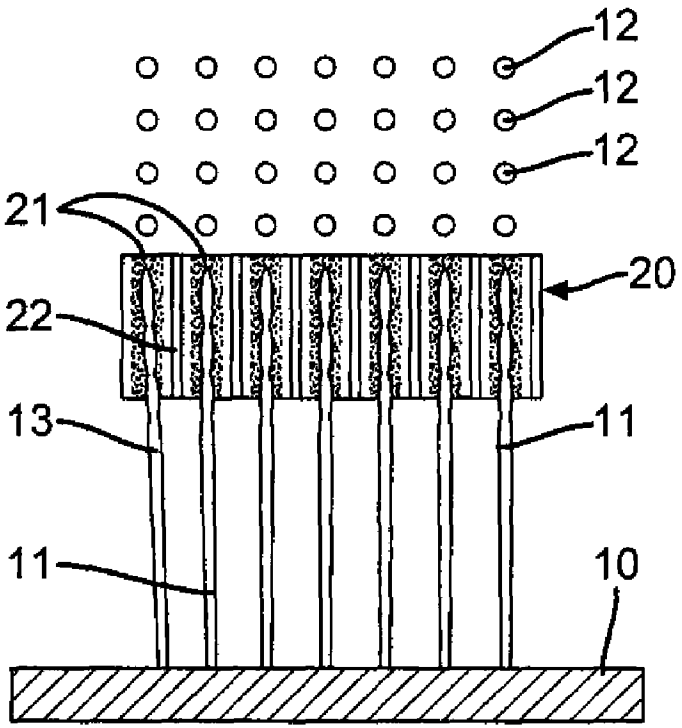
FIG. 2 is a schematic view of a continuous inkjet printhead incorporating an example embodiment of the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Generally described, the present invention describes a microfluidic device that manages the formation and control of a fluid drop(s) produced by fluid drop ejectors through interaction of a surface of a control device and a fluid jet that breaks up into the drop(s) or through interaction of a surface of a control device and the drop(s) themselves. For example, fluid drops or fluid jets can impact on at least one control device surface and subsequently exit the surface. While in contact with the surface, the surface acts on the drops or jets to provide alteration, correction, or modulation of the trajectories or other properties of the drops or jets after the drops or jets subsequently exit the surface. As used herein, a fluid jet includes a fluid column with sufficient momentum to self-eject from an aperture, for example, a nozzle of a continuous inkjet printhead.

Advantageously, the present invention provides a way to deliberately control the trajectories of drop(s) moving through the air. For example, slight and precise corrections to drop trajectories can be made to drop(s) exiting the device of the present invention. Additionally, the present invention is applicable to either drops or jets entering the device and includes, for example, drops or jets obliquely impacting a surface of the device with drops exiting the surface of the device.

The surface of the control device can include patterned features, either passive, active, or combinations thereof, for passively or actively controlling the exiting trajectories and other properties of the exiting drops or jets. Typically, the control surface acts on the impacting droplets to improve or even correct the properties of the impacting drops before the drops exit the control surface. This results in improved printing performance attributes such as reliability or image quality. For example, impacting jets that suffer from directional errors or exhibit a propensity to form satellite drops exit the control surface with at least partially corrected trajectories or with fewer satellite drops formed when compared to jets that do not impact the control surface of the control device.

Example embodiments of the present invention are discussed below with reference to FIGS. 1 through 15B.

Figure 1:
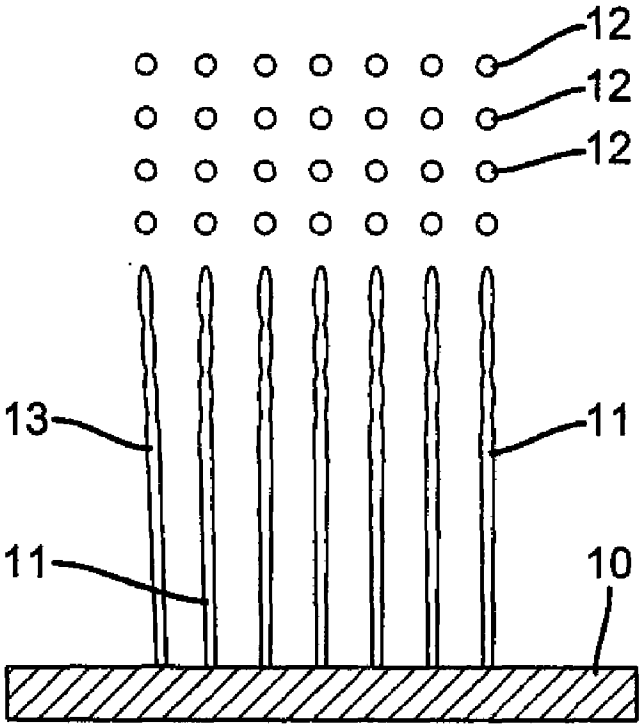
FIG. 1 PRIOR ART
FIG. 1 is a schematic view of a prior art continuous inkjet printhead including an array of fluidic ejectors with nozzles located on a printhead surface 10.

FIG. 1 is a schematic view of a prior art continuous inkjet printhead including an array of fluidic ejectors with nozzles located on a surface of printhead 10. A continuous liquid jet 11 is ejected from each nozzle. Each continuous liquid jet 11 breaks up into drops 12 of controlled volume when a conventional device applies a stimulation energy to the continuous liquid jet(s). Liquid jet 13 illustrates a misdirected jet from a defective nozzle that results in the direction of jet 13 being different from the direction of jets 11 produced by non-defective nozzles.

FIG. 2 is a schematic view of an inkjet printhead incorporating an embodiment of the present invention. In FIG. 2, a drop control device 20 includes a plurality of drop control surfaces 21 in a one to one association with the array of nozzles and disposed such that each drop control surface is located remotely from its respective nozzle. A fluidic interaction, for example, a physical contact, is made between the jet from the nozzle and the associated drop control surface 21 at or near (less than or approximately 20 times the jet diameter) the point of break off of the jet. The fluid drops or jets are controlled by the drop control surfaces 21 while in physical contact with the control surfaces in a one to one association until the drops or jets exit the drop control surface.

The drop control device 20 includes a pattern on each drop control surface 21 which passively act to guide the direction of drops exiting the drop control surface 21 toward a preferred direction regardless of the direction of travel of the jet from the associated nozzle. The drop control surfaces 21 have geometry and properties such that the fluid drops or jets have high affinity to the drop control surfaces. The drop control surfaces 21 are separated by gap regions 22 having geometry and properties such that they have low affinity to the fluid drops or jets. As shown In FIG. 2, the drop control surfaces 21 are hydrophilic surfaces and the gap regions 22 are hydrophobic surfaces. In another example embodiment, the drop control surfaces 21 can be capillary grooves and the gap regions 22 can be ridges between the capillary grooves 21. In another example embodiment, the capillary grooves 21 can have hydrophilic surface property and the gap region ridges 22 can have hydrophobic surface property.

Figure 3A:
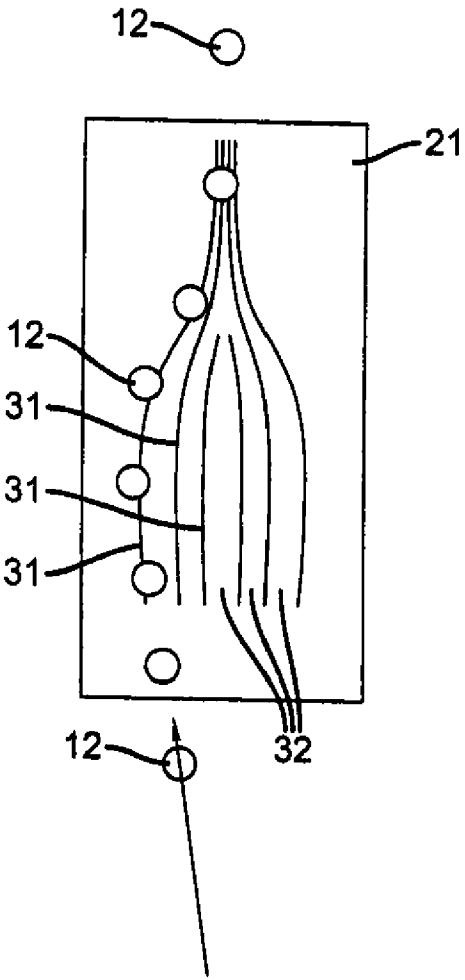
FIGS. 3A through 3C are schematic views of an example embodiment of a drop control surface of the present invention.
Figure 3B:
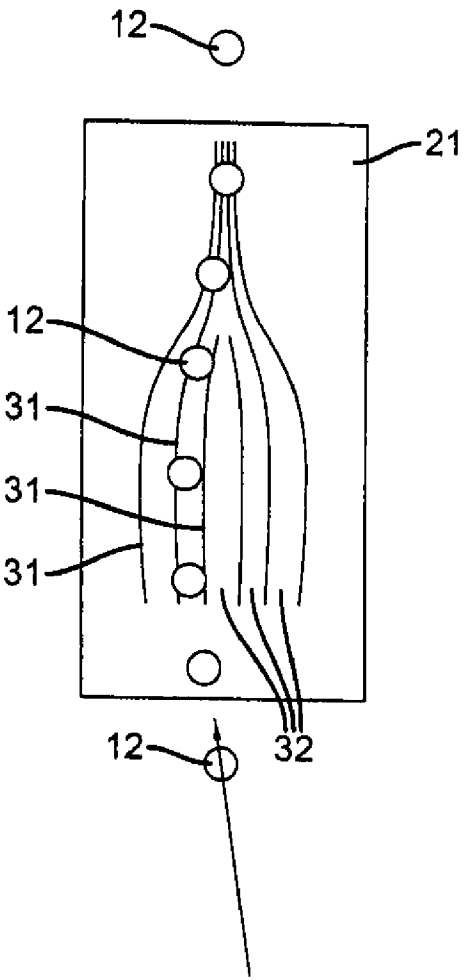
Figure 3C:
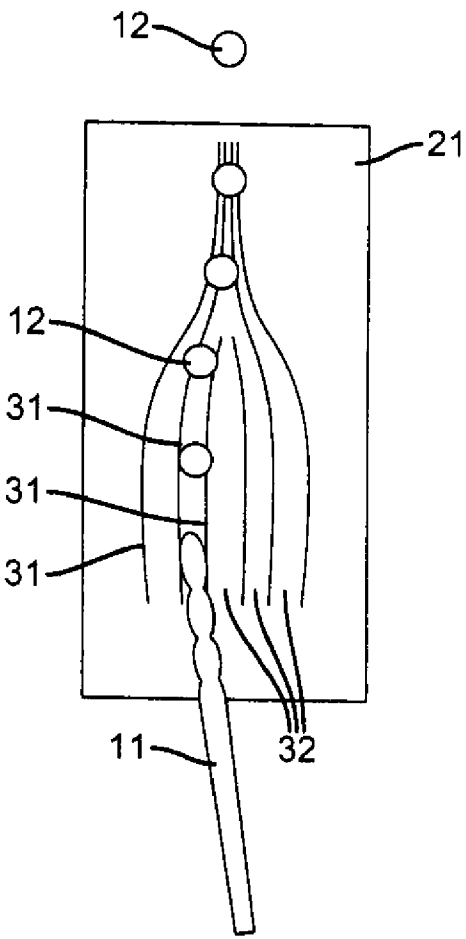

FIGS. 3A through 3C are schematic views of an example embodiment of a drop control surface 21 of control device 20. The surface pattern of the drop control surface 21 includes one or more lines of hydrophilic surface properties 31 space apart by lines of hydrophobic surface properties 32. In FIG. 3A and FIG. 3B, liquid drops misdirected by different degrees that are in contact with the drop control surface 21 are guided toward a same preferred direction by the surface pattern of the drop control surface 21. The drops shown in FIG. 3A are more misdirected than the drops shown in FIG. 3B. In FIG. 3C, liquid drops break off from the misdirected liquid jet that is in contact with the drop control surface 21 and are guided toward a preferred direction by the surface pattern of the drop control surface 21.

Alternatively in FIGS. 3A through 3C, the surface pattern of the drop control surface 21 can include one or more narrow ridges or wires 31 which preferentially guide the direction of drops exiting the drop control surface toward a preferred direction regardless of the direction of travel of the jet from the associated nozzle. In another example embodiment, the surface patterns 31 of the drop control surface 21 can be activated by a control means to guide the direction of drops exiting the drop control surface toward a preferred direction regardless of the direction of travel of the jet from the associated nozzle.

Figure 4A:
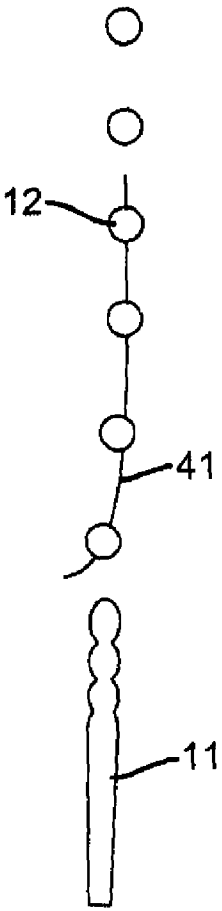
FIG. 4A is a schematic view of another example embodiment of a drop control surface of the present invention.
Figure 4B:
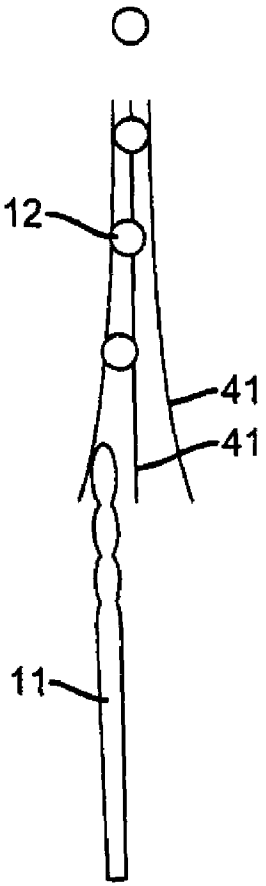
FIG. 4B is a schematic view of another example embodiment of a drop control surface of the present invention.

FIGS. 4A and 4B are schematic views of other examples of the drop control surface 21. The drop control surface 21 includes one (shown in FIG. 4A) or more (three are shown in FIG. 4B although more or less are permitted) thin wires 41 arranged in three dimensional space in the path of the liquid drops or jets to capture and guide liquid drops or jets toward a desired common trajectory of exit. Preferably, the surfaces of the wires 41 are hydrophilic so that the liquid drops or jets can be captured by the wires upon contact.

Figure 5A:
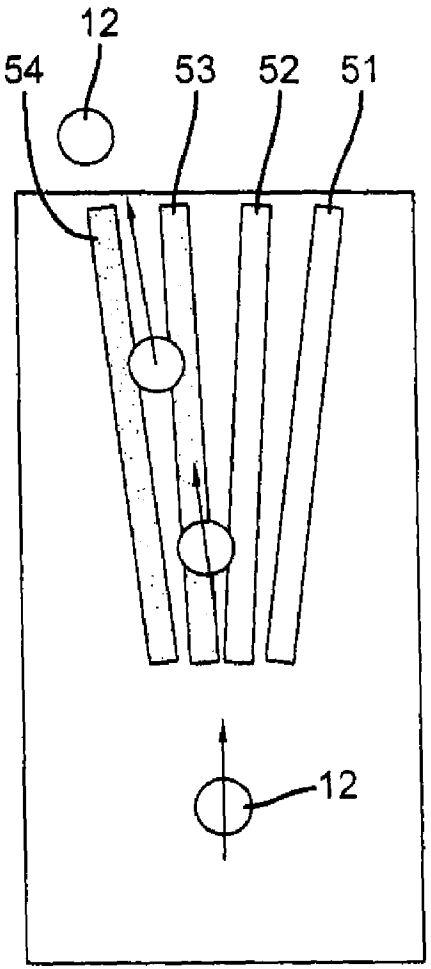
FIG. 5A is a schematic view of another example embodiment of a drop control surface of the present invention.

FIG. 5A is a schematic view of another example embodiment of a drop control surface of the present invention. Drop control surface 21 includes a pattern of electrodes 51, 52, 53 and 54 for active steering of drops 12 due to asymmetric application of wetting forces or to dielectric attraction. This example embodiment operates by the principle of dielectrophoresis (or DEP), which is a phenomenon in which a force is exerted on a dielectric drop or particle when it is subjected to a non-uniform electric field.

Dielectrophoresis is the translational motion of neutral matter caused by polarization effects in a nonuniform electric field. The dielectrophoresis force can be seen only when drops or particles are in the non-uniform electric fields. Since the dielectrophoresis force does not depend on the polarity of the electric field, the phenomenon can be observed either with AC or DC excitation. Drops or particles are attracted to regions of stronger electric field when their permittivity exceeds that of the suspension medium. When permittivity of medium is greater than that of drops or particles, this results in motion of drops or particles to the lesser electric field. DEP is most readily observed for drops or particles with diameters ranging from approximately 1 to 1000 μm. Above 1000 μm gravity, and below 1 μm Brownian motion, overwhelm the DEP forces. The main advantages of the electrical systems include geometric simplicity, easy of fabrication, absence of moving parts and voltage-based control.

The basic geometry of the embodiment, shown in FIG. 5A, includes long electrodes 51, 52, 53 and 54, patterned on an insulating substrate and then coated with a dielectric layer to insulate them electrically and to passivate them against electrolysis. Such a structure can be obtained using conventional photolithography (see, for example, Ahmed R. and Jones. T. B., Dispensing Picoliter Droplet on Substrates Using Dielectrophoresis, Journal of Electrostatics, 2006, vol. 64, No. 7-9, pp. 543-549).

In this embodiment, the force does not require drops 12 to be charged. All drops exhibit dielectrophoretic activity in the presence of electric fields. However, the strength of the force depends strongly on the medium and the electrical properties and size of the drops, as well as on the frequency of the electric field. Consequently, fields of a particular frequency can manipulate drops with great selectivity.

Figure 5B:
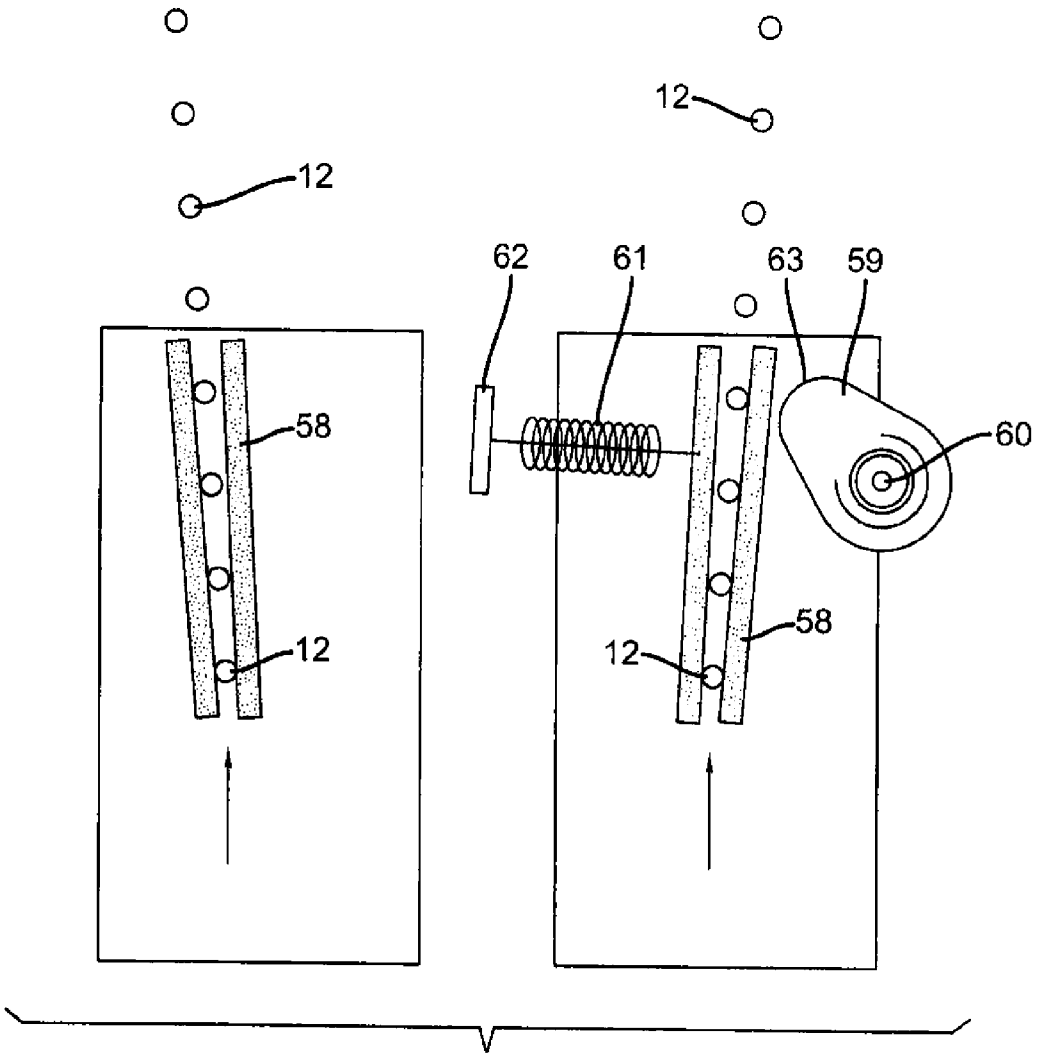
FIG. 5B is a schematic view of another example embodiment of a drop control surface of the present invention.

FIG. 5B is a schematic view of another example embodiment of a drop control surface of the present invention. A mechanically controlled steering device 58 guides drops 12 after breakoff. Drops 12 are confined and contact the steering device 58 in the form of a trough, capable of angular movement. There are many ways known to the art to control the mechanical motion of the steering device 58. For example, a camshaft 59 is utilized with a spring 61 that is attached to a fixed location 62, the steering device 58 will be in contact with the camshaft 59 as the camshaft 59 rotates on its shaft 60. Generally, the motion of the steering device 58 is from the left to the right (as viewed from left side of FIG. 5B to the right side of FIG. 5B) and back again. However, as the camshaft 59 is not circular, its profile 63 can determine the motion of the steering device 58.

Figure 6B:
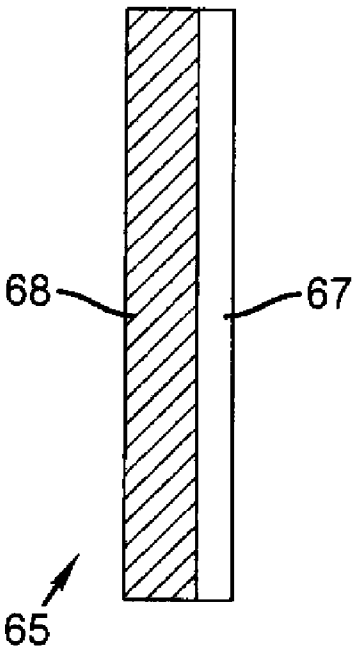
FIGS. 6A and 6B are schematic views of another example embodiment of the present invention.
Figure 6A:
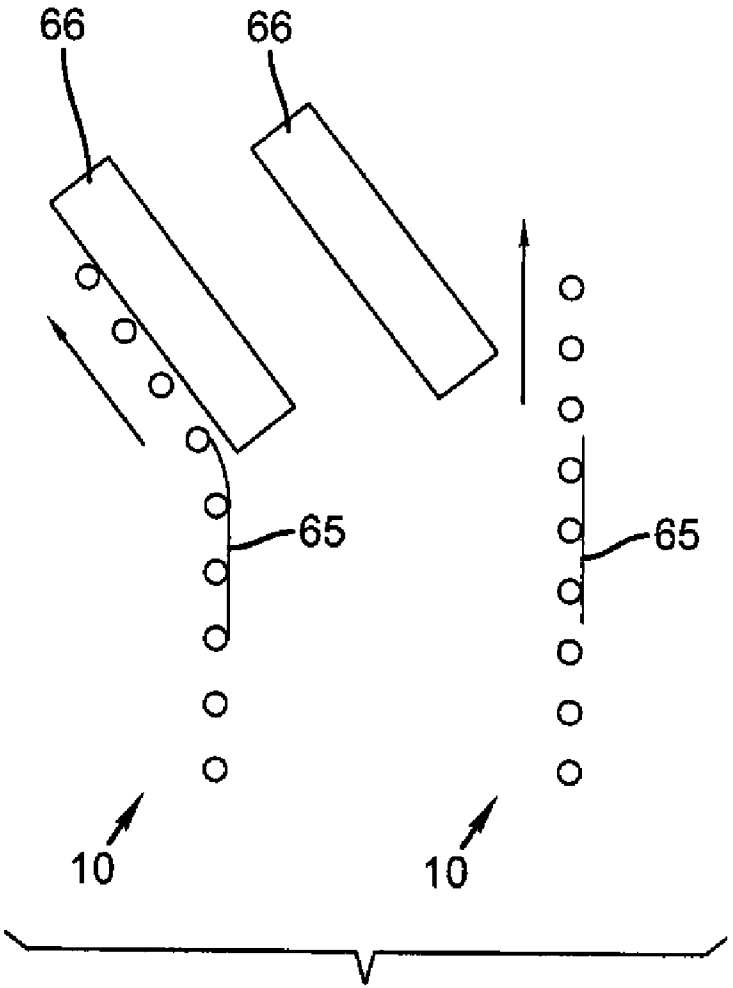

FIGS. 6A and 6B are schematic views of another example embodiment of the present invention. A deflection device 65 controls the trajectory of drops 12. Deflection device 65 can be referred to as an active cantilever. Typically, the deflection device 65 has two main positions, on and off, although more positions are permitted. When the deflection device 65 is on the on-position, shown on the left side of FIG. 6A, the deflection device 65 bends to the left, causing the drops 12 to follow gutter 66. When the deflection device 65 is on the off-position, shown on the right side of FIG. 6A, the deflection device 65 remains straight, allowing the drops 12 to travel along a non-gutter path.

The deflection device 65 can be made of two metal sheets bonded together. The two metals have different coefficients of thermal expansion. When an electric current is applied to the metals, they will expand different in length. The deflection device 65 will bend toward to the metal with lower coefficient of thermal expansion. This type of device is often referred to as a thermal bi-morph or a bimetallic actuator although thermal tri-morphs (three metal layers) can also be used.

Another mean to deflect is to utilize piezo-electric material to make a cantilever. A piezoelectric actuator works on the principle of piezoelectricity. Piezoelectricity is the ability of crystals and certain ceramic materials to generate a voltage in response to applied mechanical stress. The piezoelectric effect is reversible in that piezoelectric crystals, when subjected to an externally applied voltage, can change shape by a small amount. (For instance, the deformation is about 0.1% of the original dimension in PZT.) The effect finds useful applications such as the production and detection of sound, generation of high voltages, electronic frequency generation, microbalance, and ultra fine focusing of optical assemblies. Barium titanate can be caused to have piezoelectric properties by exposing it to an electric field.

Piezoelectric materials are used to convert electrical energy to mechanical energy and vice-versa. The precise motion that results when an electric potential is applied to a piezoelectric material is of primordial importance for nanopositioning. Actuators using the piezo effect have been commercially available for 35 years and in that time have transformed the world of precision positioning and motion control. Piezo actuators can perform sub-nanometer moves at high frequencies because they derive their motion from solid-state crystalline effects. They have no rotating or sliding parts to cause friction. Piezo actuators can move high loads, up to several tons. Piezo actuators present capacitive loads and dissipate virtually no power in static operation. Piezo actuators require no maintenance and are not subject to wear because they have no moving parts in the classical sense of the term.

For deflection device 65 in the present invention using piezoelectric material, the poling axis of the material is directed from one electrode to the other. Such a configuration is a thickness mode actuator. When the voltage is applied between the electrodes, the thickness of the piezoelectric will change, resulting in a relative displacement of up to 0.2%. Displacement of the piezoelectric actuator is primarily a function of the applied electric field of strength and the length of the actuator, the forced applied to it and the property of the piezoelectric material used. With the reverse field, negative expansion (Contraction) occurs. If both the regular and reverse fields are used, a relative expansion (strain) up to 0.2% is achievable with piezo stack actuators. The piezo material 67 should be placed only on one side of the deflection device 65 (shown in FIG. 6B). The other side 68 can be other material such as metal that do not have piezoelectric function. When the piezo material extends and contracts according to the electric field and the material on the other side 68 remains its original length, the deflection device will bend. Cantilever tip can be a patterned two-dimensional surface or in the form of a wire.

Figure 7:
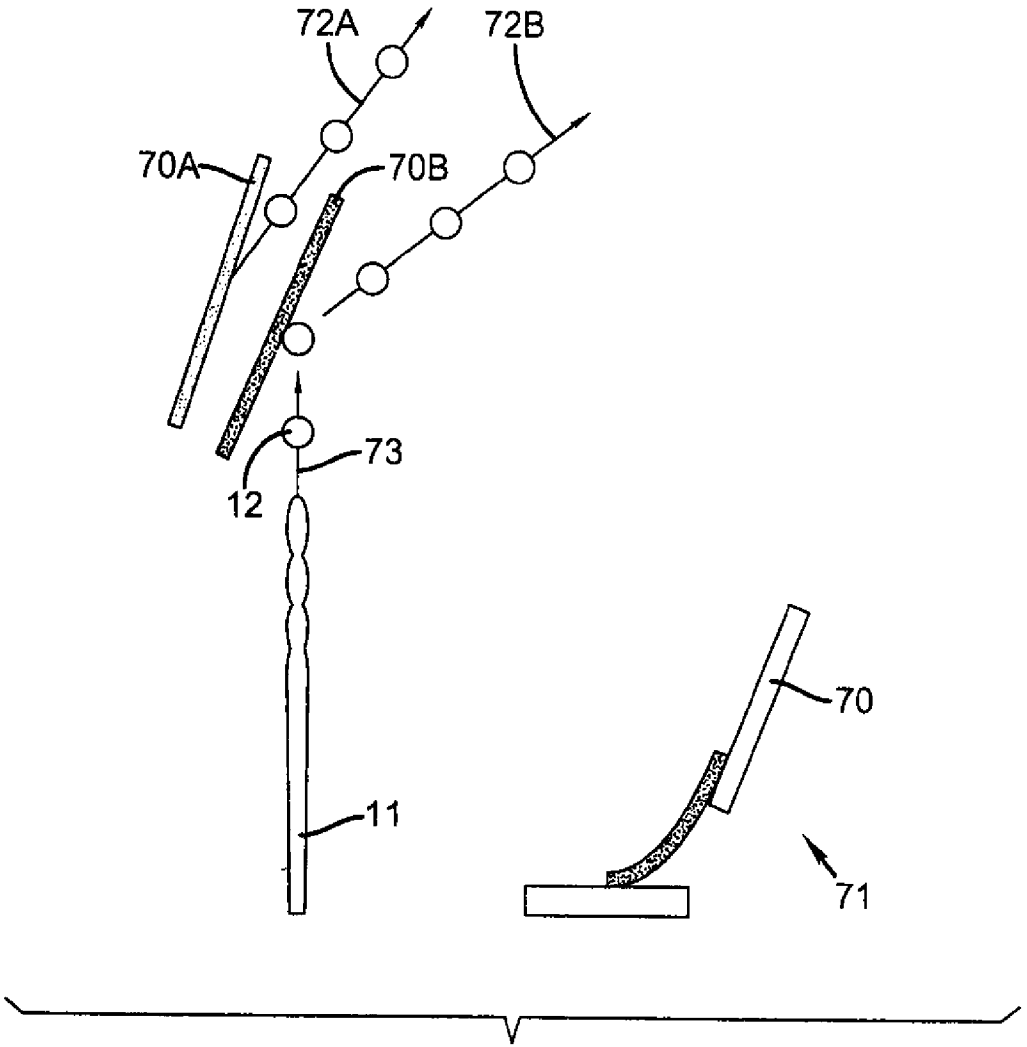
FIG. 7 is a schematic view of another example embodiment of the present invention.

FIG. 7 is a schematic view of another example embodiment of the present invention. Drops 12 reflect elastically from a hydrophobic control surface 70 whose angular position with respect to the trajectory of the impinging drops is controlled by a micromechanical actuator 71 (shown on the right side of FIG. 7) to enable directional control of the drops exiting the control surface. Typically, actuator 71 is a piezo actuator, a bimetal actuator or a trimetal actuator as described above. Actuator 71 moves control surface 70 between the positions designated 70A and 70B (shown on the left side of FIG. 7). The reflected travel path of the drops 72A and 72B depends on the location of control surface 70 relative to the travel path 73 of the drops. In this manner, the angle of reflection of the drops and the reflected travel path of the drops can be controlled and adjusted by actuator 71.

Figure 8B:
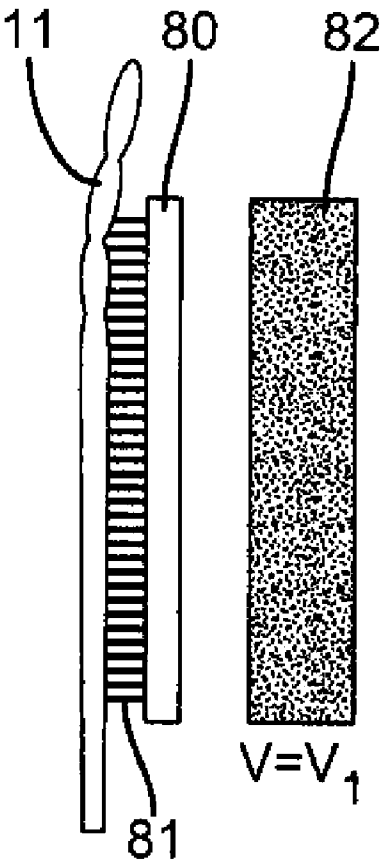
FIGS. 8A and 8B are schematic views of another example embodiment of the present invention.
Figure 8A:
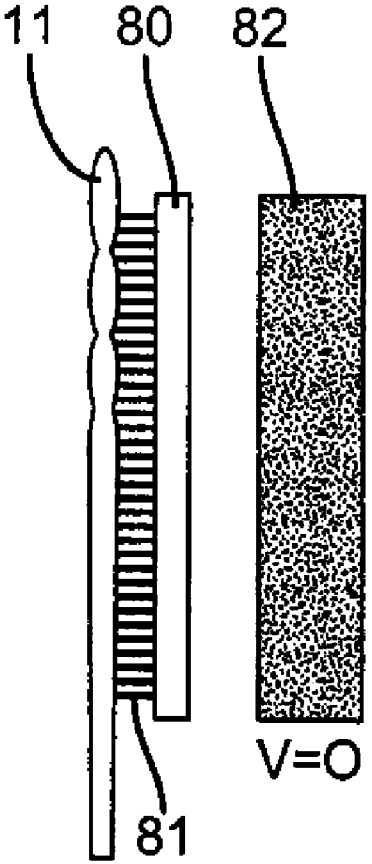

FIGS. 8A and 8B are schematic views of another example embodiment of the present invention. Decreasing the hydrophobicity of the control surface, for example, by application of a voltage, slows the jet velocity near the control surface in comparison to the velocity on the side of the jet opposite the control surface, thereby altering the jet trajectory. In FIGS. 8A and 8B, surfaces 80 and 82 include electrodes. Surface 80 contains surface pattern 81 that changes the hydrophobicity of the surface. In FIG. 8A, no electric field is applied between the electrodes on surfaces 80 and 82. Jet 13 remains traveling in its original direction (along its original travel path). In FIG. 8B, electric potential is applied between the electrodes on surfaces 80 and 82. Therefore, by the principle of dielectrophoresis, jet 13 is pulled to contact surface 80 and its surface pattern 81 changing the direction (the travel path) of the fluid jet 11.

Figure 8D:
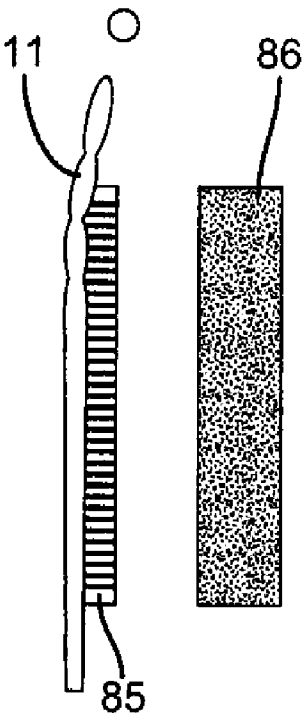
FIGS. 8C and 8D are schematic views of another example embodiment of the present invention.
Figure 8C:
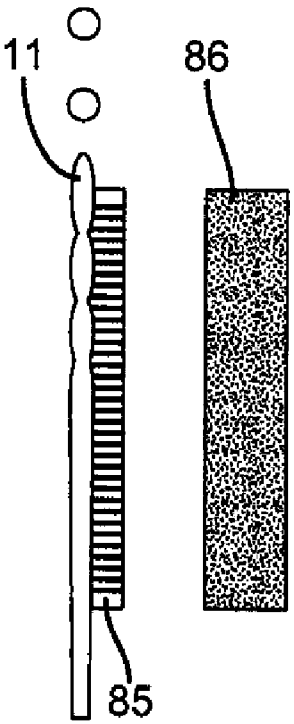

FIGS. 8C and 8D are schematic views of another example embodiment of the present invention. Decreasing airflow to the control surface 85, for example, by application of air pressure to the side of a porous control surface 85 opposite the jet 13, slows the jet velocity near the control surface 85, thereby altering the jet trajectory. The decreasing of airflow can be accomplished using airflow control mechanism 86, for example, a controllable positive pressure source, a controllable negative pressure source, or a combination of both types.

Figure 9:
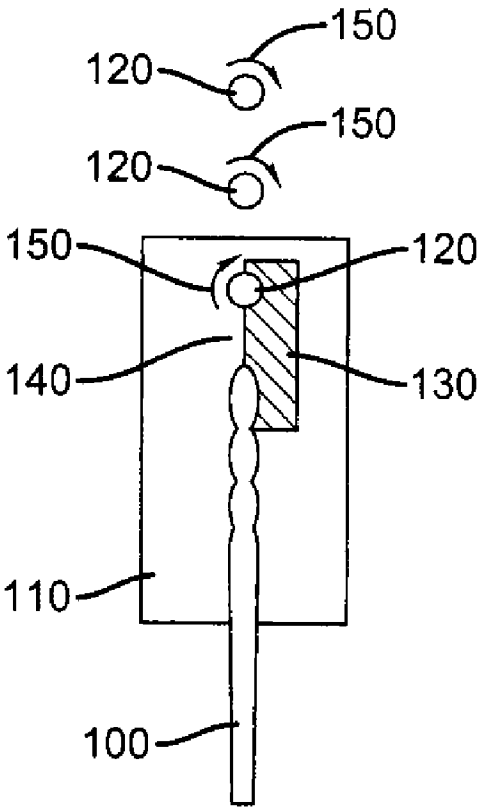
FIG. 9 is a schematic view of another example embodiment of a drop control surface of the present invention.

FIG. 9 is a schematic view of another example embodiment of a drop control surface of the present invention. A fluid jet 100, drop control surface 110, and drops 120 are shown. The drop control surface 110 is positioned to physically contact the drops 120 formed from the breakup of jet 100. Jet 100 is created using conventional techniques, for example, using a pressurized liquid source. The breakup of jet 100 into drops 120 is also accomplished using conventional techniques, for example, a piezoelectric transducer or thermo-capillary stimulation of the jet.

The drop control surface 110 is patterned with modified surface regions 130 that have properties different than those of the unmodified surface regions 140 of drop control surface 110. The modified surface regions 130 are substantially hydrophilic, while the unmodified surface regions 140 are substantially hydrophobic. It can be appreciated that the properties of the modified surface regions 130 can be different in many ways from those of the unmodified surface regions 140 including differences in surface roughness, the presence of grooves, ridges, or combinations thereof.

The drop control surface 110 is positioned to contact the drops 120 formed from the breakup of jet 100 in such a way that the drops 120 simultaneously contact the modified surface regions 130 and the unmodified surface regions 140. Since the properties of the modified surface regions 130 and the unmodified surface regions 140 are different, the motion properties of the drops 120 are altered. As shown, the drops 120 acquire a rotational motion as indicated by arrow 150 due to their simultaneous asymmetric interaction with modified surface region 130 and the unmodified surface region 140 of drop control surface 110. However, it is understood that various other changes in the motion properties of the drops 120 including a change in drop velocity or drop trajectory.

FIGS. 10 A and 10B are schematic views of another example embodiment of a drop control surface of the present invention. A fluid jet 200, drop control surface 210, and drops 220 are shown. The drop control surface 210 is positioned to physically contact the drops 220 formed from the breakup of jet 200. Jet 200 is created using conventional techniques, for example, using a pressurized liquid source. The breakup of jet 200 into drops 220 is also accomplished using conventional techniques, for example, a piezoelectric transducer or thermo-capillary stimulation of the jet.

The drop control surface 210 is patterned with a plurality of modified surface regions 230 that have properties different than those of the unmodified surface regions 240 of drop control surface 210. In the preferred embodiment the modified surface regions 230 are substantially hydrophilic, while the unmodified surface regions 240 are substantially hydrophobic. It is understood that the properties of the modified surface regions 230 can be different in many ways from those of the unmodified surface regions 240 including differences in surface roughness, the presence of grooves, ridges, or combinations thereof.

Figure 10B:
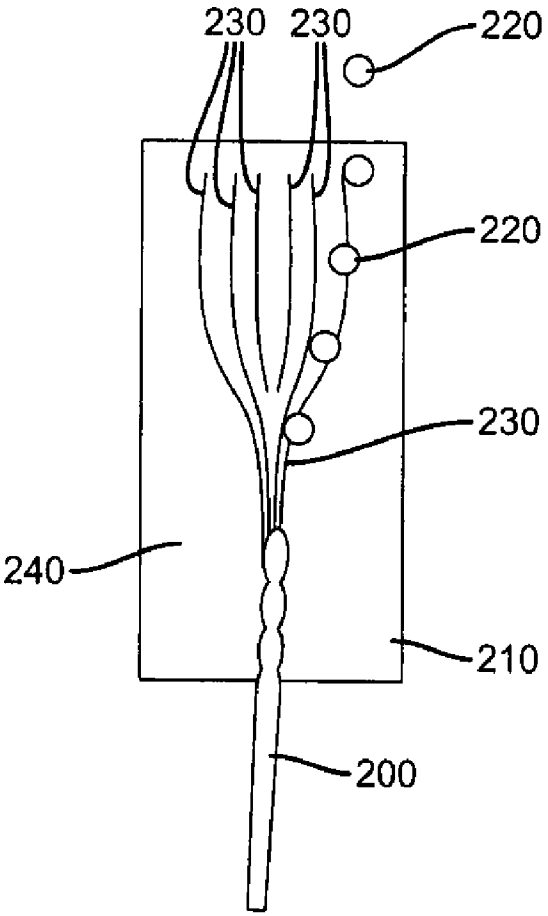
FIGS. 10A and 10B are schematic views of another example embodiment of a drop control surface of the present invention.
Figure 10A:
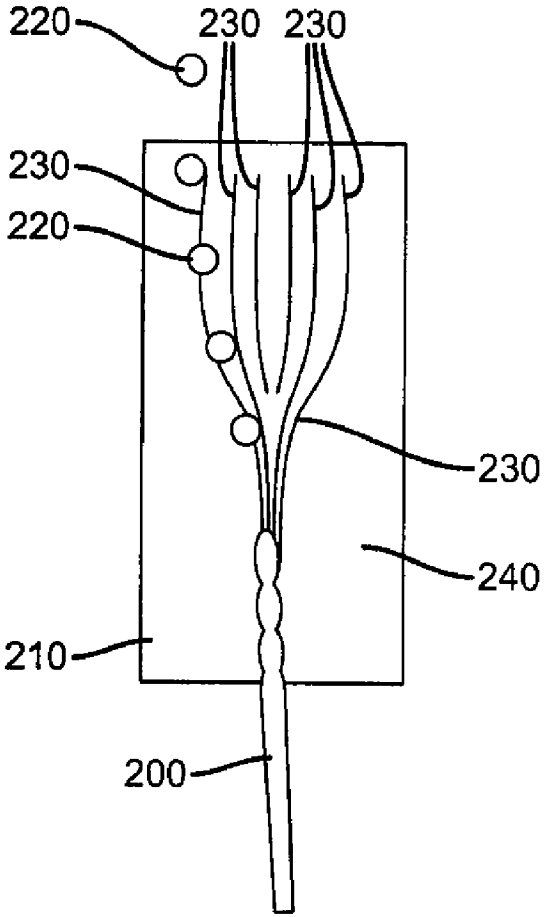

The drop control surface 210 is positioned to contact the drops 220 formed from the breakup of jet 200 in such a way that the drops 220 contact at least one of the modified surface regions 230. The modified surface regions 230 interact with the drops 220 during contact in such a way that the drops 220 substantially maintain contact with the modified surface regions 230 until they separate from control surface 210, thereby altering the trajectory of the drops 220 as shown in FIGS. 10A and 10B. The other motion properties of the drops 220 can be altered during contact with modified surface regions 230 of drop control surface 210 including changes in the velocity and rotational motion of the drops 220 etc.

Figure 11:
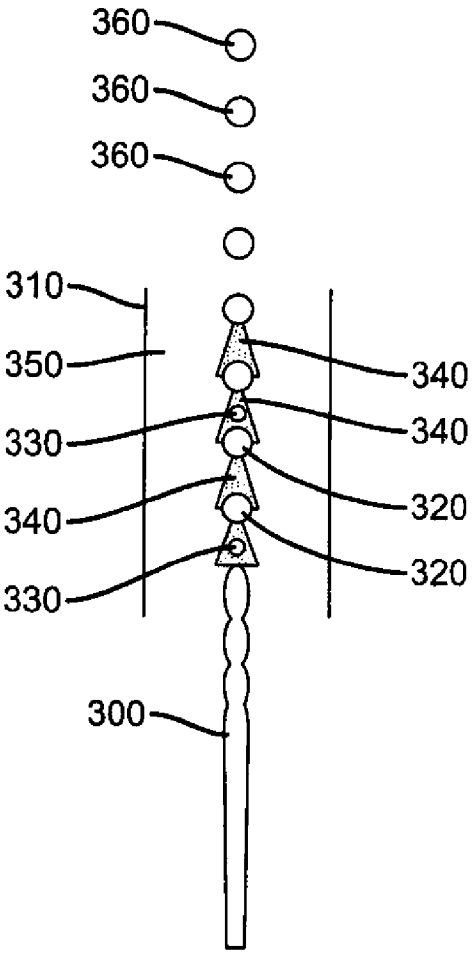
FIG. 11 is a schematic view of another example embodiment of a drop control surface of the present invention.

FIG. 11 is a schematic view of another example embodiment of a drop control surface of the present invention. A fluid jet 300, drop control surface 310, main drops 320, and satellite drops 330 are shown. The drop control surface 310 is positioned to physically contact the main drops 320 and satellite drops 330 formed from the breakup of jet 300. Jet 300 is created using conventional techniques, for example, using a pressurized liquid source. The breakup of jet 300 into drops 320 is also accomplished using conventional techniques, for example, a piezoelectric transducer or thermo-capillary stimulation of the jet.

The drop control surface 310 is patterned with a plurality of modified surface regions 340 that have properties different than those of the unmodified surface regions 350 of drop control surface 310. The modified surface regions 340 have properties that act to reduce the velocity of the main drops 320 and satellite drops 330 upon contact. As shown, the modified surface regions 340 are substantially hydrophilic. However, the desired action of the modified surface regions 340 to slow down the main drops 320 and satellite drops 330 upon contact can be accomplished using other techniques, for example, by altering the surface roughness, adding ridges, or grooves to the modified surface regions 340.

The satellite drops 330 that contact the drop control surface 310 experience more deceleration than the main drops 320 because of their lower inertia. This will result in the merging of satellite drops 330 into the trailing main drops 320 to form large drops 360 upon separation from the drop control surface 310. The patterns on the modified surface regions 340 are chosen to guide the main drops 320 and satellite drops 330 upon contact thereby keeping them from undesired displacement left or right from their original trajectory.

Figure 12A:
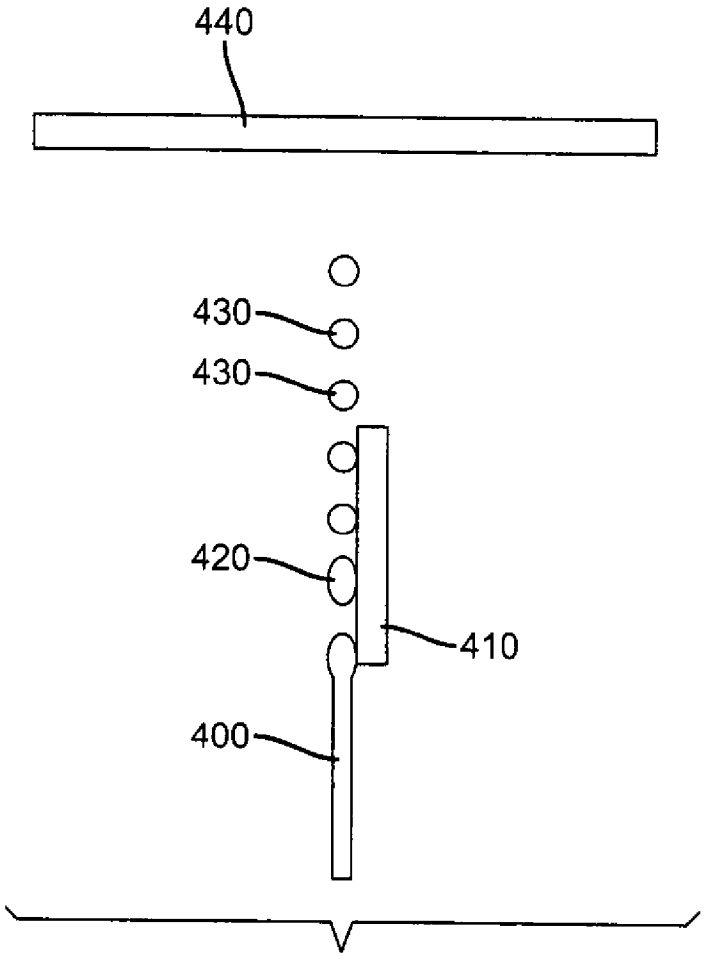
FIG. 12A is a schematic view of another example embodiment of the present invention.

FIG. 12A is a schematic view of another example embodiment of the present invention. A fluid jet 400, drop control surface 410, drops 420, slowed drops 430 and receiver 440 are shown. The drop control surface 410 is positioned to physically contact the drops 420 which form from the breakup of jet 400. Jet 400 is created using conventional techniques, for example, using a pressurized liquid source. The breakup of jet 400 into drops 420 is also accomplished using conventional techniques, for example, a piezoelectric transducer or thermo-capillary stimulation of the jet.

The drop control surface 410 has properties that act to reduce the velocity of the drops 420 and upon contact thereby transforming the stream of drops 420 from the breakup of jet 400 into a stream of slowed drops 430. As shown, the control surface 410 is substantially hydrophilic. However, the desired action of the drop control surface 410 to slow down of the drops 420 upon contact can be achieved using other properties of the drop control surface 410, for example, by modifying the surface roughness of the drop control surface 410.

As the drops 420 slow down upon contact with drop control surface 410 their spacing uniformly decreases while their volumes are preserved. The effective $\lambda/D$ limit of the printing system (not shown) is therefore significantly increased, and the printing speed is proportionally increased. In this case, the impacting jet velocity can be greater than the maximum velocity allowed for drops landing on the receiver 450 (usually determined by the drop velocity at which drop 'splattering' occurs). Thus, the maximum fluid flow rate is increased over what would otherwise be possible.

Figure 12B:
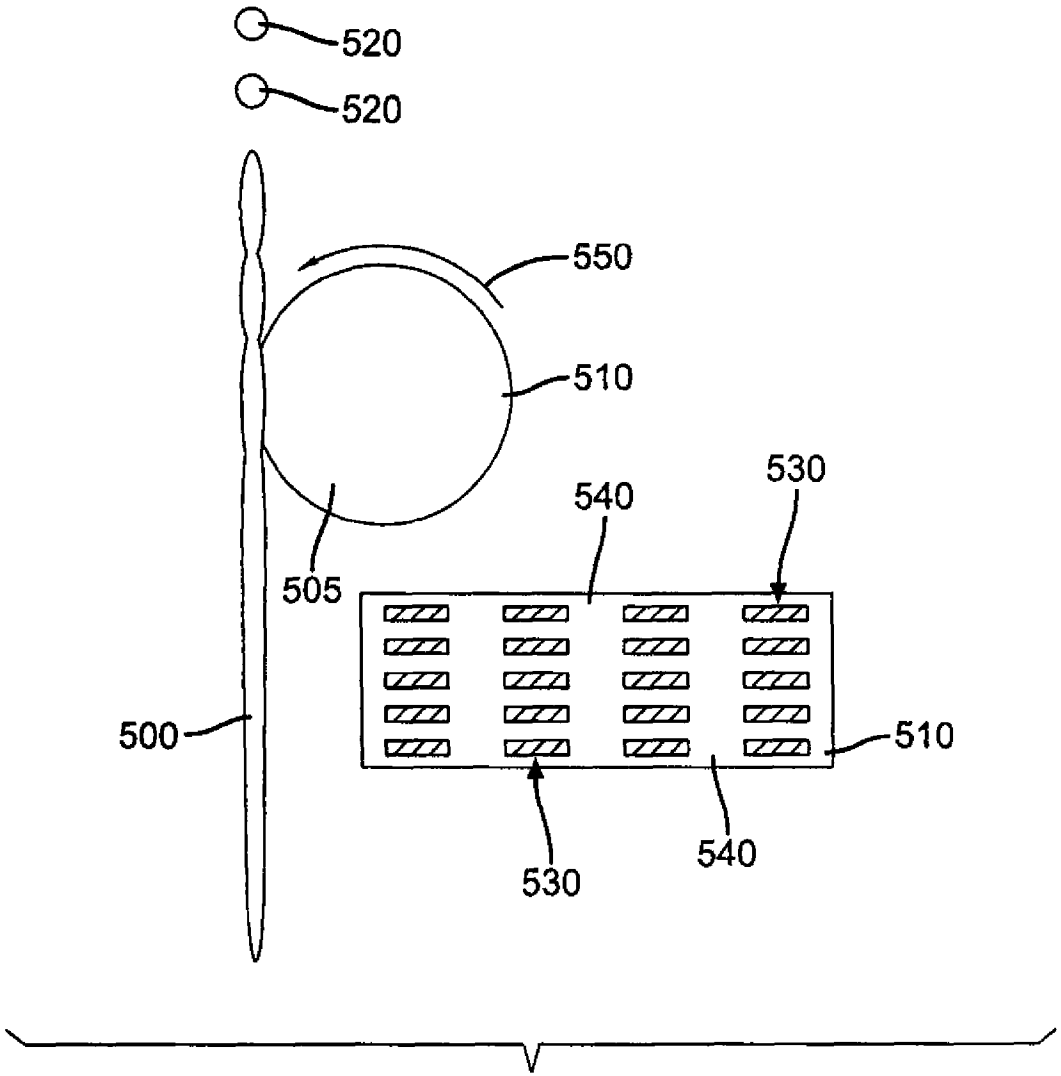
FIG. 12B is a schematic view of another example embodiment of the present invention.

FIG. 12B is a schematic view of another example embodiment of the present invention. A fluid jet 500, drop control surface 510, and drops 520 are shown. The drop control surface 510 is positioned to physically contact the jet 500. Jet 500 is created using conventional techniques, for example, using a pressurized liquid source.

As shown, drop control surface 510 is in the form of a cylinder 505 that is patterned with a plurality of modified surface regions 530 that have properties different than those of the unmodified surface regions 540 of drop control surface 510. The modified surface regions 530 have properties that act to perturb the jet 500 upon contact so as to cause the jet to break into drops 520. Drop control surface 510 is rotating counterclockwise as indicated by rotation arrow 550. The rotation of drop control surface 510 enables a plurality of modified surface regions 530 to contact the jet in a periodic fashion thereby stimulating jet breakup using a periodic perturbation which can be adjusted by varying the rotational speed of drop control surface 510.

The modified surface regions 530 are substantially hydrophilic and the unmodified surface regions 540 are hydrophobic. However, the modified surface regions 530 that cause the jet 500 to breakup into drops 520 upon contact can be achieved using other properties, for example, by modifying the surface roughness of the modified surface regions 530.

Figure 13B:
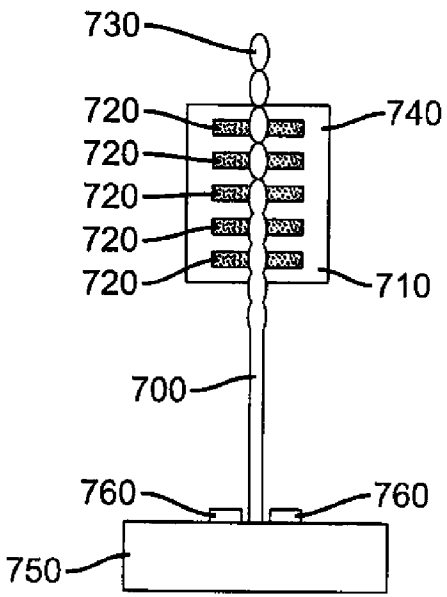
FIG. 13B is a schematic view of a continuous inkjet printhead incorporating another example embodiment of the present invention.
Figure 13A:
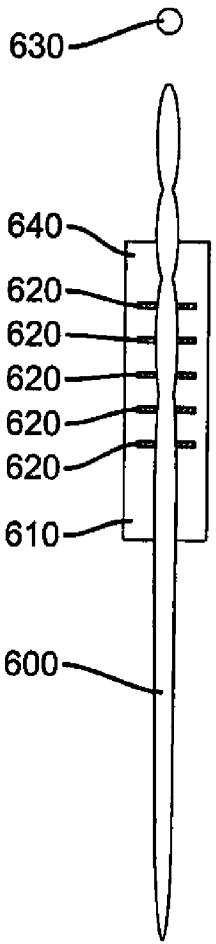
FIG. 13A is a schematic view of another example embodiment of a drop control surface of the present invention.

FIG. 13A is a schematic view of another example embodiment of a drop control surface of the present invention. A fluid jet 600, drop control surface 610, and drops 630 are shown. The drop control surface 610 is positioned to physically contact jet 600. Jet 600 is created using conventional techniques, for example, using a pressurized liquid source. Control surface 610 imparts energy to the jet at or near a jet stimulation wavelength so that the exiting jet rapidly begins breaking up into drops 630. The breakup of jet 600 into drops 630 can also be assisted using conventional techniques, for example, a piezoelectric transducer or thermo-capillary stimulation of the jet.

The drop control surface 610 is patterned with modified surface regions 620 that have properties different than those of the unmodified surface regions 640 of drop control surface 610. As shown, the modified surface regions 620 are substantially hydrophilic, while the unmodified surface regions 640 are substantially hydrophobic. The modified surface regions 620 are patterned in a periodic array where the spacing between modified regions can be adjusted to actively stimulate breakup of the fluid jet 600. It can be appreciated that other properties of modified surface regions 620 can be different from those of the unmodified surface regions 640 including differences in surface roughness, the presence of grooves, ridges, or combinations thereof.

FIG. 13B is a schematic view of a continuous inkjet printhead 750 incorporating another example embodiment of the present invention. A fluid jet 700, drop control surface 710, and drops 730 are shown. The drop control surface 710 is positioned to physically contact the jet 700. Jet 700 is created using conventional techniques, for example, using a pressurized liquid source. Control surface 710 imparts energy to the jet at or near a jet stimulation wavelength so that the exiting jet rapidly begins breaking up into drops 730. The breakup of jet 700 into drops 730 can be assisted with a secondary stimulation device that employs conventional techniques, for example, a piezoelectric transducer or thermo-capillary stimulation of the jet. In FIG. 13B, the secondary stimulation is a heater 760 positioned around the nozzle that ejects liquid jet 700.

The drop control surface 710 is patterned with modified surface regions 720 that have properties different than those of the unmodified surface regions 740 of drop control surface 710. As shown, the modified surface regions 720 are substantially hydrophilic, while the unmodified surface regions 740 are substantially hydrophobic. The modified surface regions 720 are patterned in a periodic array where the spacing between modified regions can be adjusted to actively simulate breakup of the fluid jet 700. It can be appreciated that other properties of modified surface regions 720 can be different from those of the unmodified surface regions 740 including differences in surface roughness, the presence of grooves, ridges, or combinations thereof.

Figure 14B:
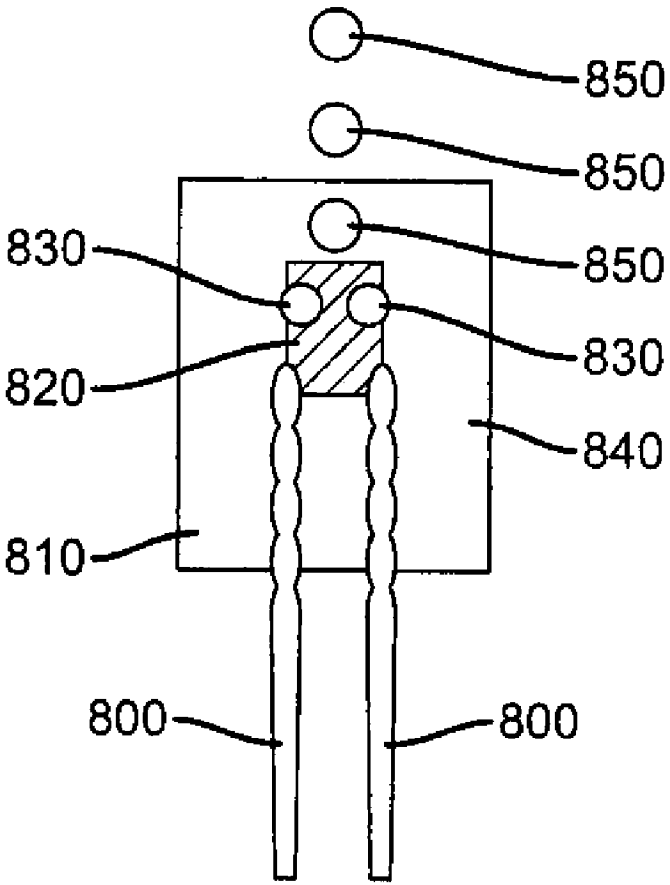
FIGS. 14A and 14B are schematic views of another example embodiment of a drop control surface of the present invention.
Figure 14A:
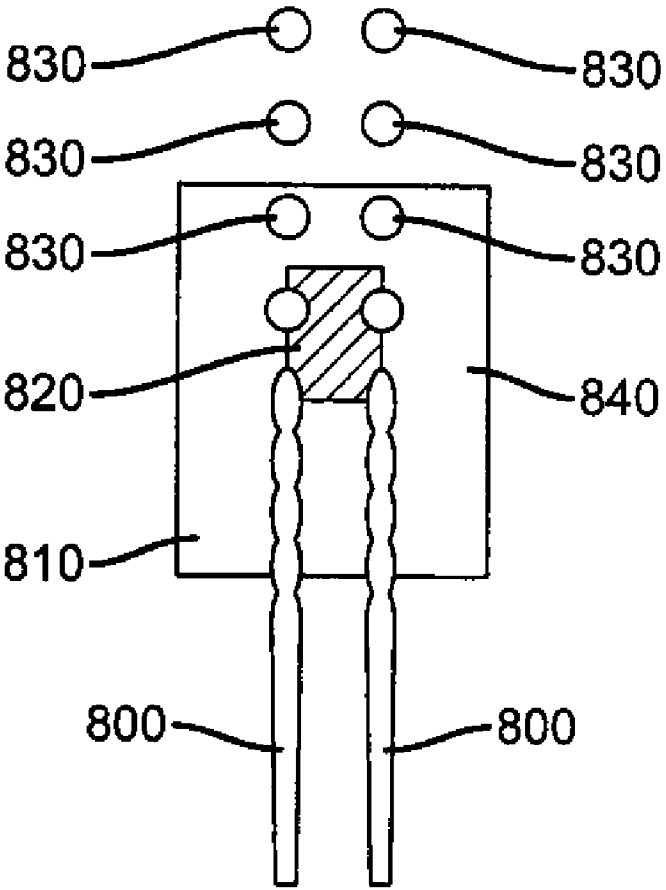

FIGS. 14A and 14B are schematic views of another example embodiment of a drop control surface of the present invention. Two fluid jets 800, a drop control surface 810, and drops 830 are shown. The drop control surface 810 is positioned to physically contact the drops 830 formed from the breakup of jet 800. Jet 800 is created using conventional techniques, for example, using a pressurized liquid source. The breakup of jet 800 into drops 830 is also accomplished using conventional techniques, for example, a piezoelectric transducer or thermo-capillary stimulation of the jet.

The drop control surface 810 is patterned with modified surface regions 820 that have properties different than those of the unmodified surface regions 840 of drop control surface 810. As shown, the modified surface regions 820 are substantially hydrophilic, while the unmodified surface regions 840 are substantially hydrophobic. The modified surface regions 820 interact with the two fluid jets 800 upon contact such that adjacent jets or drops from adjacent jets are caused to merge to form a bigger drop 850 when compared to drops 830.

The invention has been described in detail with particular reference to certain preferred embodiments thereof, but it will be understood that variations and modifications can be effected within the scope of the invention.

PARTS LIST

10 printhead
11 fluid jet
12 drops
13 fluid jet
20 drop control device
21 drop control surface
22 gap regions
31 hydrophilic surface properties
32 hydrophobic surface properties
41 thin wires
51 electrode
52 electrode
53 electrode
54 electrode
58 mechanically controlled steering device
59 camshaft
60 shaft
61 spring
62 fixed location
63 profile
65 deflection device
66 gutter
67 piezo material
68 side
70 hydrophobic control surface
71 micromechanical actuator
80 surface
81 surface pattern
82 surface
85 control surface
86 airflow control mechanism
100 fluid jet
110 drop control surface
120 drops
130 modified surface regions
140 unmodified surface regions
150 arrow
200 fluid jet
210 drop control surface
220 drops
230 modified surface regions
240 unmodified surface regions
300 fluid jet
310 drop control surface
320 main drops
330 satellite drops
340 modified surface regions
350 unmodified surface regions
360 large drops
400 fluid jet
410 drop control surface
420 drops
430 slowed drops
440 receiver
450 receiver
500 fluid jet
510 drop control surface
520 drops
530 plurality of modified surface regions
540 unmodified surface regions
550 rotation arrow
600 fluid jet
610 drop control surface
620 modified surface regions
630 drops
640 unmodified surface regions
700 fluid jet
710 drop control surface
720 modified surface regions

730 drops
740 unmodified surface regions
750 printhead
800 fluid jets
810 drop control surface
820 modified surface regions
830 drops
840 unmodified surface regions
850 drop

The invention claimed is:

1. A method of controlling fluid flow comprising:

providing a moving fluid including a fluid flow characteristic;

providing a fluid control device including a fluid control surface, a portion of the fluid control surface being moveable;

causing the fluid to contact the fluid control surface of the fluid control device; and causing the fluid to interact with the fluid control surface of the fluid control device by moving the moveable portion of the fluid control surface while the fluid is in contact with the fluid control surface such that the fluid flow characteristic of the fluid after interacting with the fluid control surface of the fluid control device is different from the fluid flow characteristic of the fluid before interaction with the fluid control surface of the fluid control device depending on the position of the moveable portion of the fluid control surface.

2. The method of claim 1, wherein the moving fluid is at least one of a liquid drop, a liquid jet, and a liquid film.

3. The method of claim 1, wherein the fluid flow characteristic includes at least one of a velocity, a direction of flow, a drop rate, a drop volume, a drop rotational momentum, and a geometry of the fluid.

4. The method of claim 1, wherein the fluid control surface is hydrophobic.

5. The method of claim 1, wherein the fluid control surface is hydrophilic.

6. The method of claim 1, further comprising:

causing a fluid drop to break off from the fluid when the fluid contacts the fluid control surface of the fluid control device using a drop stimulation force.

7. A microfluidic device comprising:

a fluid source that provides a moving fluid, the moving fluid including a fluid flow characteristic; and a fluid control device including a fluid control surface a portion of the fluid control surface being moveable, the fluid control surface being positioned relative to the moving fluid such that the moving fluid contacts the fluid control surface of the fluid control device, the moveable portion of the fluid control surface being moveable while the fluid is in contact with the fluid control surface such that the fluid flow characteristic of the moving fluid after interaction with the fluid control surface of the fluid control device is different from the fluid flow characteristic of the moving fluid before interaction with the fluid control surface of the fluid control device.

8. The device of claim 7, wherein the moving fluid is at least one of a liquid drop, a liquid jet, and a liquid film.

9. The device of claim 7, wherein the fluid flow characteristic includes at least one of a velocity, a direction of flow, a drop rate, a drop volume, a drop rotational momentum, and a geometry of the fluid.

10. The device of claim 7, wherein the fluid control surface is hydrophobic.

11. The device of claim 7, wherein the fluid control surface is hydrophilic.

12. The device of claim 7, wherein a fluid drop breaks off from the fluid when the fluid contacts the fluid control surface of the fluid control device.

13. The device of claim 7, wherein the fluid source comprises a continuous inkjet printhead.

* * * * *